United States Patent [19]

Schittenhelm et al.

[11] Patent Number: 4,970,375

[45] Date of Patent: Nov. 13, 1990

[54] HIGH-TEMPERATURE HEATING SYSTEMS AND A PROCESS FOR THEIR PRODUCTION

[75] Inventors: Hans-Joachim Schittenhelm, Leverkusen, Fed. Rep. of Germany; Paul Zybell, Dalmine-Brembo, Italy

[73] Assignee: Bayer Aktiengesellschaft, Leverkusen Bayerwerk, Fed. Rep. of Germany

[21] Appl. No.: 332,166

[22] Filed: Apr. 3, 1989

[30] Foreign Application Priority Data

Apr. 15, 1988 [IT] Italy ..... 20218 A/88

[51] Int. Cl.[5] ..... H05B 3/28

[52] U.S. Cl. ..... 219/543; 219/457

[58] Field of Search ..... 219/543, 443, 457, 458, 219/459, 464, 465, 468

[56] References Cited

U.S. PATENT DOCUMENTS 3,694,627 9/1972 Blatchford ..... 219/543
4,713,530 12/1987 Schittenlelm ..... 219/543

FOREIGN PATENT DOCUMENTS 0112922 6/1983 European Pat. Off. .
3536268 10/1985 Fed. Rep. of Germany .

*Primary Examiner*—Roy N. Envall, Jr.
*Attorney, Agent, or Firm*—Connolly and Hutz

[57] ABSTRACT

A high-temperature heating element useful as the heating means in baking ovens, washing machines, water heaters, toasters and dishwashers comprises an enamelled metal substrate and an overlying multilayer system consisting of an inner layer of an insulating glass, metallic conductor lines and an outer layer of a surface glass, wherein said multi-layer system is joined to the enamelled metal substrate by an intermediate layer.

10 Claims, No Drawings

HIGH-TEMPERATURE HEATING SYSTEMS AND A PROCESS FOR THEIR PRODUCTION

This invention relates to high-temperature heating systems consisting of a composite system of an enamelled metal substrate, an electrically insulating base glass layer applied thereto, metallic heating elements and a chemically resistant glass surface layer and of an intermediate layer between the enamelled metal substrate and the glass insulating layer, to a process for the production of these heating systems and to their use.

BACKGROUND OF THE INVENTION

Low-temperature heating systems based on enamelled steel sheet have long been known. In their case, electrical resistances in the form of heating lacquers, metal-containing pastes or metallic conductor lines are directly applied to the enamelling. This conventional enamelling, which in this case functions as an electrical insulator, has the disadvantage that its electrical volume resistance decreases with increasing temperature, so that the use of heating systems such as these is confined to a low temperature range of up to 150° C.

GERMAN No. 3 536 268 describes a heating element for high inuse temperatures (>150° C.). The heating element disclosed is a composite system consisting of a steel plate to which an electrically insulating glass base layer, metallic conductor lines and a chemically resistant glass surface layer acting as a sealing layer are applied. This heating element is capable of withstanding temperatures of up to 400° C. without any change in the resistance of the glass insulating layer. The electrically insulating glass layer used in this case consists of an alkali-free calcium-aluminium borosilicate (see also GERMAN No. 3,446,554).

The disadvantage of these heating elements is that the steel sheet has to be decarburized, degreased, pickled and nickel-plated so that the insulating glass layer adheres firmly to the steel sheet. The other heating elements described in the above-cited patent specification (where a steel sheet coated with a base enamel is used instead of a treated steel sheet) are attended by the disadvantage that the volume resistance of the insulating glass layer again decreases after a short time and after repeated heating and cooling of the element, so that the serviceability of the element is seriously affected or even destroyed.

Accordingly, the object of the present invention is to provide heating elements in which, on the one hand, the steel does not have to be pretreated and in which, on the other hand, the insulating glass layer on which the conductor lines are situated retains its volume resistance.

BRIEF DESCRIPTION OF THE INVENTION

It has now been found that new, high-temperature resistant heating systems do not have these disadvantages when the high-temperature heating system consisting of an enamelled metal substrate, preferably steel sheet, on which is situated a multilayer system consisting of an inner layer of an insulating glass, metallic conductor lines and an outer layer of a surface glass, characterized in that the layer system is joined to the enamelled metal substrate via an intermediate layer.

DETAILED DESCRIPTION OF THE INVENTION

The heating element of this invention comprises an enamelled metal substrate and an overlying multi-layer system which is joined to the enamelled metal substrate by an intermediate layer. The multi-layer system comprises an inner layer (i.e., the layer closest to the substrate) of insulating glass, metallic conductor lines and an outer layer of surface glass.

The intermediate layer consists of a mixture of a zirconium phosphate glass and a boron-titanium frit, this mixture preferably consisting of 35 to 55% by weight zirconium phosphate glass and 65 to 45% by weight boron-titanium frit.

The insulating glass layer is an alkali-free calciumaluminium borosilicate glass.

The outer surface glass layer consists of a mixture of a boron-titanium frit and a zirconium phosphate glass.

The zirconium phosphate glasses mentioned above may have the following composition:

| | |
|---|---|
| $ZrO_2$ | 26–30% by weight |
| $P_2O_5$ | 21–25% by weight |
| $SiO_2$ | 7–12% by weight |
| $Na_2O$ | 6–10% by weight |
| $K_2O$ | 8–12% by weight |
| $TiO_2$ | 6–10% by weight |
| BaO | 8–12% by weight |
| F | 3–8% by weight |

The boron-titanium frits mentioned above are standard frit types known per se (cf. for example A. I. Andrews, Porcelain Enamels, page 277). The insulating glasses mentioned above may have the following composition:

| | |
|---|---|
| $B_2O_3$ | 43–48% by weight |
| CaO | 29–34% by weight |
| $SiO_2$ | 8–15% by weight |
| $Al_2O_3$ | 7–10% by weight |
| MgO | 1–2% by weight |

The high-temperature heating systems according to the invention are produced by multi-screen printing in which the various layers are successively applied to the enamelled metal substrate and are then baked together in a single operation at 780° to 850° C. and preferably at at 780° to 820° C.

The layers are applied in the form of pastes, the pastes being prepared by thorough mixing of the intermediate frit in the form of a fine powder (particle size range 1 to 25 μm), the insulating glass or the surface glass with a thermoplastic medium, an oil medium or with a medium of a water-soluble organic suspension.

The mixing ratio of powder to the medium is preferably of the order of 4:1.

Where the oil medium or the water-soluble organic suspension is used, intermediate drying is necessary depending on the layer application whereas, where the thermoplast is used, the actual common baking process is preceded by a single, common evaporation process (at around 100° to 150° C.).

Depending on the consistency of the medium, the pastes are applied either at room temperature or at elevated temperature (above all where thermoplasts are used) using the screen.

The oil medium used is preferably pine oil (80 to 90% by weight) containing 3 to 15% by weight collophony or derivatives thereof, 1 to 4% by weight cellulose derivatives and 2 to 5% by weight acrylates, while the organic suspension preferably contains a mixture of 5 to 10% by weight cellulose derivatives, 20 to 30% by weight ethyl alcohol and 60% by weight glycol derivatives.

The thermoplastic medium used is preferably stearyl alcohol (70 to 80% by weight) containing 5 to 15% by weight glycol ester, 5 to 15% by weight acrylates and 5 to 10% by weight collophony.

The heating conductors are also applied in the form of a paste of the above-mentioned media and very finely divided metal particles, preferably silver, ruthenium, a blend of the two metals, nickel or copper.

The layer thickness of the layers applied by screen printing is regulated through the mesh width and filament thickness of the printing screen. Screens containing 62 to 84 meshes/cm are preferably used for application of the heating conductor pastes while screens containing 34 to 42 meshes/cm are preferably used for the application of the other pastes.

The heating conductor layer has a thickness of the order of 15 to 20 μm while the other layers have thicknesses of the order of 50 μm.

In many cases, various heating conductor lines of different metals are applied, which means that the corresponding number of screen printing applications has to be carried out according to the number of different metals.

By virtue of their advantageous properties, the high-temperature heating systems according to the invention are preferably used as heating elements in baking ovens, washing machines, water heaters and toasters.

The following observations and the following Example are intended to illustrate the present invention without limiting it in any way.

A metal substrate, preferably a steel sheet, which is intended for use as a high-temperature heating element, is coated with a known enamel frit by standard methods (wet process or electrostatic process) and baked. The metal substrate thus enamelled is then coated with, for example, four different pastes of thermoplastic medium in the form of 5 screen printing applications which are then baked at 780° to 850° C.

Where thermoplastic media (for example a thermoplast based on sterol and a plasticizer) are used for the screen printing applications, there is no need for intermediate drying after each screen printing application (cf. for example oil medium). The actual baking process merely has to be preceded by a single common evaporation process.

The intermediate frit, which consists of a mixture of 35 to 55% by weight of a zirconium phosphate glass and 65 to 45% by weight of a commercial boron-titanium frit, is thoroughly mixed in the form of a fine powder (particle size range 1 to 25 μm) with the thermoplast and the plasticizer for 1 hour at around 75° C. in a closed container, followed by homogenization on a three-roll stand of which the cylinders are also heated to around 60° C. The mixing ratio of powder to medium is 4:1. The homogenized product is printed in liquid form onto the enamelled metal substrate through the (directly or indirectly) heated printing screen.

The screen has 34 to 42 meshes/cm.

The pastes containing the insulating glass and the surface glass are prepared and applied in exactly the same way.

The heating conductor paste consists of very finely divided metal particles in the thermoplastic medium. Screens containing 62 to 84 meshes/cm are used for its application.

After the layers have been successively applied, the thermoplastic medium is evaporated off in a drying or heating tunnel at around 100° to 150° C. before the actual baking process at 780° to 850° C.

EXAMPLE

Intermediate frit (printing screen 34 meshes/cm):

50% by weight zirconium phosphate glass: 50% by weight boron-titanium frit: commercial titanium white enamel frit 15.6 g: quartz powder
19.5 g: sodium tripolyphosphate
1.8 g: potassium carbonate
7.5 g: titanium dioxide
20.5 g: zirconium silicate
18.7 g: monobarium phosphate
10.9 g: monopotassium phosphate
9.7 g: potassium fluosilicate Insulating glass (34 mesh/cm screen; two applications to increase layer thickness):

250.2 g: boric acid
176.7 g: calcium carbonate
12.0 g: magnesium carbonate
5.1 g: quartz
57.9 g: clay (48% $SiO_2$, 38% $Al_2O_3$)

Conductor lines (72 mesh/cm screen):

Finely divided silver in a thermoplastic medium (70–80% by weight stearyl alcohol, 5–15% by weight glycol ester, 5–15% by weight acrylates and 5–10% by weight colophony).

Surface glass (34 mesh/cm screen):

50% by weight zirconium phosphate glass and 50% by weight boron-titanium frit as for the intermediate frit.

Each screen-printed layer is applied in a thickness of 50 μm while the heating conductor layer varies from 15 to 20 μm in thickness.

Screen printing is carried out using commercially available machines. The same printing system may also be applied to metal substrates of geometrically complicated shape by means of so-called "pad printing" using special media.

Baking is carried out in a single operation at 800° to 820° C.

What is claimed is:

1. A high-temperature heating element comprising an enamelled metal substrate and an overlying multilayer system consisting of an inner layer of an insulating glass, metallic conductor lines and an outer layer of a surface glass, wherein said multi-layer system is joined to the enamelled metal substrate by an intermediate layer.

2. A high-temperature heating element as claimed in claim 1 wherein the metal substrate is a steel sheet.

3. A high-temperature heating element as claimed in claim 2 wherein said intermediate layer is a mixture of a zirconium phosphate glass and a boron-titanium frit.

4. A high-temperature heating element as claimed in claim 3 wherein the mixture consists of 35 to 55% by weight zirconium phosphate glass and 65 to 45% by weight boron-titanium frit.

5. A high-temperature heating system as claimed in claim 4 wherein the zirconium phosphate glass has the following composition:

| | |
|---|---|
| $ZrO_2$ | 26–30% by weight |
| $P_2O_5$ | 21–25% by weight |
| $SiO_2$ | 7–12% by weight |
| $Na_2O$ | 6–10% by weight |
| $K_2O$ | 8–12% by weight |
| $TiO_2$ | 6–10% by weight |
| BaO | 8–12% by weight |
| F | 3–8% by weight |

6. A high-temperature heating element as claimed in claim 1 wherein said intermediate layer is a mixture of a zirconium phosphate glass and a boron-titanium frit.

7. A high-temperature heating system as claimed in claim 6 wherein the mixture consists of 35 to 55% by weight zirconium phosphate glass and 65 to 45% by weight boron-titanium frit.

8. A high-temperature heating system as claimed in claim 7 wherein the zirconium phosphate glass has the following composition:

| | |
|---|---|
| $ZrO_2$ | 26–30% by weight |
| $P_2O_5$ | 21–25% by weight |
| $SiO_2$ | 7–12% by weight |
| $Na_2O$ | 6–10% by weight |
| $K_2O$ | 8–12% by weight |
| $TiO_2$ | 6–10% by weight |
| BaO | 8–12% by weight |
| F | 3–8% by weight |

9. A process for the production of the high-temperature heating element claimed in claim 1 which comprises successively applying to the enamelled metal substrate the intermediate layer, the inner layer of insulating glass, the metallic conductor lines, and the outer layer of surface glass by multi-screen printing and then baking the layered assembly in a single operation at 780° to 850° C.

10. High-temperature heating element claimed in claim 1 as the heating element in baking ovens, washing machines, water heaters, toasters and dishwashers.

* * * * *